US012408725B1

(12) United States Patent
Birnbaum

(10) Patent No.: US 12,408,725 B1
(45) Date of Patent: Sep. 9, 2025

(54) INSOLE

(71) Applicant: Bernardo Birnbaum, Miami, FL (US)

(72) Inventor: Bernardo Birnbaum, Miami, FL (US)

( * ) Notice: Subject to any disclaimer, the term of this patent is extended or adjusted under 35 U.S.C. 154(b) by 0 days.

(21) Appl. No.: 17/723,173

(22) Filed: Apr. 18, 2022

(51) Int. Cl.
*A43B 7/145* (2022.01)
*A43B 3/00* (2022.01)
*A43B 7/149* (2022.01)

(52) U.S. Cl.
CPC ..... *A43B 3/0036* (2013.01); *A43B 7/145* (2013.01); *A43B 7/149* (2013.01)

(58) Field of Classification Search
CPC ..... A43B 3/0057; A43B 13/10; A43B 13/183; A43B 17/00; A43B 17/003; A43B 17/14; A43B 3/0036
See application file for complete search history.

(56) References Cited

U.S. PATENT DOCUMENTS 2,129,588 A * 9/1938 Nickerson ..... A43B 23/22 36/76 R
2,909,854 A * 10/1959 Edelstein ..... A43B 7/1425 36/43
3,999,558 A * 12/1976 Barnwell ..... A43B 7/142 36/145
5,204,173 A * 4/1993 Canary ..... D21H 13/14 162/146
5,438,768 A * 8/1995 Bauerfeind ..... A43B 7/1445 36/43
5,768,803 A * 6/1998 Levy ..... A43B 17/02 36/43
6,026,599 A * 2/2000 Blackwell ..... A43B 7/14 36/43
6,038,790 A * 3/2000 Pyle ..... A43B 7/144 36/28
6,199,303 B1 * 3/2001 Luthi ..... A43B 7/1425 36/31
7,980,006 B2 * 7/2011 Aveni ..... A43B 21/36 36/114
2007/0033834 A1 * 2/2007 Cheskin ..... A43B 7/223 36/28
2013/0081306 A1 * 4/2013 Park ..... A43B 17/14 36/43
2015/0289584 A1 * 10/2015 Nurse ..... A43B 3/0031 36/89
2017/0105482 A1 * 4/2017 Smaniotto ..... A43B 17/006
2018/0000196 A1 * 1/2018 Lovell ..... A43B 7/148
2018/0027922 A1 * 2/2018 Orand ..... A43B 13/141
2018/0168281 A1 * 6/2018 Case ..... A43B 13/185
2021/0112920 A1 * 4/2021 Dinshaw ..... B33Y 80/00
2021/0298412 A1 9/2021 Takahashi et al.
2022/0273070 A1 * 9/2022 Head ..... A43B 13/125

* cited by examiner

*Primary Examiner* — Jocelyn Bravo
(74) *Attorney, Agent, or Firm* — Sanchelima & Associates, P.A.; Jesus Sanchelima; Christian Sanchelima

(57) ABSTRACT

A shoe insole comprising a cut out that follows the projection of the metatarsal area, said insole made out of a rigid material, and with a first predetermined thickness so that a user's weight is transmitted to the user's toes and calcaneal anterior area while minimizing the weight applied to the metatarsal area.

1 Claim, 1 Drawing Sheet

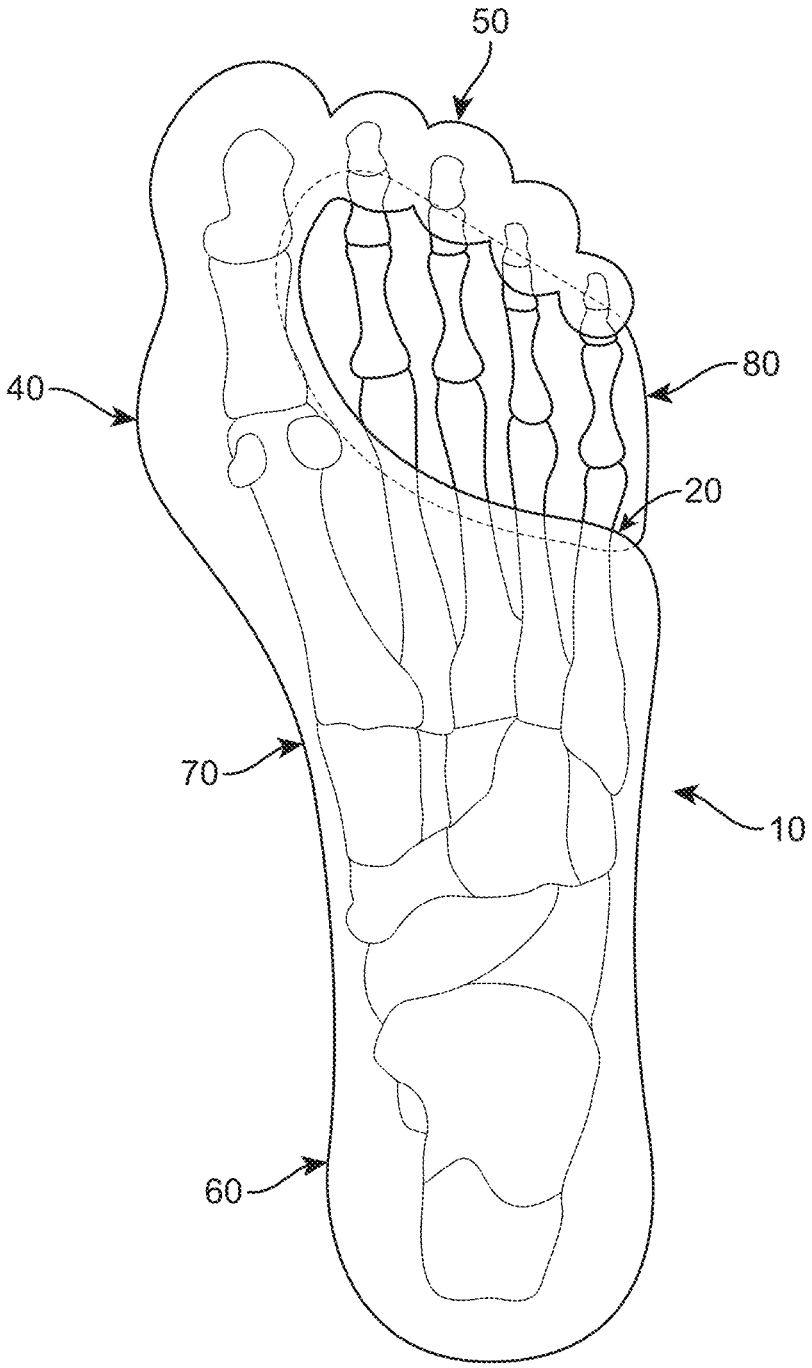
50
40
80
20
70
10
60

INSOLE

BACKGROUND OF THE INVENTION

1. Field of the Invention

The present invention relates to insoles and, more particularly, to an insole that shifts the weight of a user away from the metatarsal area and towards the front of the insole to coincide with the user's toes.

2. Description of the Related Art

Several designs for insoles have been designed in the past. None of them, however, are designed to shift the user's weight toward his or her toes from the metatarsal area. Some conditions, like the Morton neuroma, involves the inflammation of the metatarsal area. Applying pressure (the user's weight) in that area results in pain and further aggravation of the condition. The present invention resolves this problem.

Applicant believes that a related reference corresponds to U.S. Pub. No. US2021/0298412A1 issued for Shoe Insole published on Sep. 30, 2021. However, as it is disclosed in paragraphs 0066 and 0067, the reference teaches away from the invention by trying to avoid the application of the user's weight in his or her toes.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an insole that diverts the user's weight towards his or her toes relieving the metatarsal area from pressure.

It is yet another object of this invention to provide such an insole that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents a top view of the insole subject of the present application.

DETAILED DESCRIPTION OF THE EMBODIMENTS OF THE INVENTION

Referring now to the drawings, where the present invention is generally referred to with numeral 10. The forefoot section 40 of insole 10 includes the projected areas of the phalanx bones and metatarsal bones two through five. A bay or cutout 20 in forefoot section 40 coincides with the user's metatarsal and phalanx projected areas except the distal phalanx bones projected end area 50. End area 50 has a peninsular shape for cooperatively supporting the underside of a user's toes' distal phalanx bones receiving most of his/her weight.

The thickness of insole 10 extends at a constant thickness continuously from hindfoot section 60 to midfoot section 70 and lastly forefoot section 40. Insole 10 is made out of rigid material. Optionally, a soft cushion 80 can mounted to insole 10 to cover cutout 20 provided that no significant weight is applied to the metatarsal area.

It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoe insole configured to be worn by a wearer, the insole comprising:

a forefoot section;

a midfoot section; and a hindfoot section;

wherein said insole is made of a rigid material and includes a first predetermined thickness;

wherein said forefoot section comprises a bay that extends directly from a lateral edge of the forefoot section towards a medial portion of the forefoot section and extends through the entire thickness of the insole, removing a portion of said insole that is configured to underlie the wearer's second through fifth proximal phalanges and a forward portion of the wearer's second through fifth metatarsal bones;

wherein said forefoot section further comprises a toe end portion directly adjacent to the bay, the toe end portion having a peninsular shape that is configured to underlie the wearer's first through fifth distal phalanges, wherein the toe end portion includes a plurality of rounded portions configured to respectively correspond to each of the wearer's first through fifth distal phalanges;

wherein, when the insole is used, the user's weight is transmitted to the user's distal phalanges and the user's anterior calcaneal area, while minimizing the weight applied to the user's metatarsal area.

* * * * *